United States Patent [19]

Kuosmanen

[11] 4,286,570

[45] Sep. 1, 1981

[54] EFFICIENCY HEATER

[76] Inventor: Vesa M. Kuosmanen, 30 High St., Acton, Mass. 01720

[21] Appl. No.: 891,904

[22] Filed: Mar. 30, 1978

[51] Int. Cl.[3] ..... F24H 3/00

[52] U.S. Cl. ..... 126/99 R; 126/70

[58] Field of Search ..... 126/99 R, 99 P, 99 D, 126/106, 109, 70, 71, 99 A, 99 C

[56] References Cited

U.S. PATENT DOCUMENTS

| | | | |
|---|---|---|---|
| 82,761 | 10/1868 | Smith | 126/70 |
| 340,844 | 4/1876 | White | 126/109 |
| 371,465 | 10/1887 | Laube | 126/70 |
| 1,413,122 | 4/1922 | Kay | 126/99 |
| 1,428,047 | 9/1922 | Mott | 126/99 |
| 1,661,660 | 3/1928 | Gulliow | 126/99 |
| 1,912,397 | 6/1933 | Murdock | 126/99 |

*Primary Examiner*—Samuel Scott
*Assistant Examiner*—Gerald A. Anderson

[57] ABSTRACT

Three elements are secured together in new and unique fashion to form a heating unit, movable and installable as an integral unit and capable of obtaining maximum BTU's from the fuel used. These elements are (1) an outer jacket, which defines the design and outline of the heater, (2) an inner jacket, forming with the outer jacket a residual burning chamber, narrow in cross section and relatively high in vertical extent to provide maximum heat transfer surface, and (3) an A- or tent-shaped fire box or combustion chamber, enclosed by and secured to the inner and outer jackets. The tent-shaped fire box extends from the extreme lower end of the heater to its upper limit. The edges of the walls of the fire box are secured to outer and inner jackets in sealed relationship, dividing the areas within the heater into heat producing and heat conducting areas and clean air passageways. The configuration of the inner jacket 14 is an incomplete cylinder. It has separated edges, each slanted to conform and attach to one of the slanted walls of the fire box. The broken away area of the cylinder is triangular. One edge of the triangle is secured to an edge of the fire box wall. The other edge meets and attaches to the outer surface of the opposite wall and in the vicinity of a final vent. Thus access is provided to the residual burning chamber from the interior of the fire box, and egress therefrom is provided in the form of a final vent. The residual burning materials are thus conducted in a circular path around the clean air passageway, thus all possible energy units are extracted from whatever fuel is used.

3 Claims, 4 Drawing Figures

EFFICIENCY HEATER

BACKGROUND

In the past, sources of heating commodities, such as oil and gas have been considered to be inexhaustible. Measures for extracting the most possible energy units from the fuel being consumed was not considered necessary, practical or desirable. Waste was normal. With the rising costs of these commodities and their availability and inexhaustibility becoming more and more into question, the market has become crowded with home heaters attempting to control waste, and to extract every possible BTU from the fuel being consumed. For a multiplicity of reasons, the efficiency sought has not been forth coming. Multiplicity of parts, difficult and complicated manufacturing processes, difficulty in installation, inefficiency in operation, frequent necessity for repair: these are some of the difficulties experienced.

The object of the present invention is, therefore, to provide a heater which overcomes these difficulties, to provide one which is easily manufactured, easily installed because of its integral nature and one which looks simple but which operates with extremely high efficiency, obtaining all possible energy units from the fuel used.

Complete combustion of fuel means less contamination of the atmosphere.

SUMMARY

A tent or A-shaped fire box extends from the lower to the upper limits of the heater, and functions as a combustion chamber. It is enclosed in a unit which is comprised of concentric outer and inner jackets. The inner jacket is smaller in diameter, and terminates a distance from the base of the outer jacket. It is an incomplete cylinder having separated end edges which are cut at an angle to the vertical to conform and be attachable to the walls of the fire box. The inner jacket forms a residual burning chamber with the outer jacket. The residual burning chamber cross section is narrow and relatively high in vertical dimension. Maximum surface is thus presented for heat transfer. The slanted fire box walls, extending as they do the entire height of the heater, also present maximum surface for heat transfer. Air entering the openings at the base of the outer jacket is heated immediately by heat transfer from the fire box walls and, as it travels upward, is further heated by both the fire box walls and by the wall of the residual burning chamber. It will now be seen that that maximum utilization of all of the elements of heat transfer, i.e. convection, conduction, and radiation, have been realized and that the device is deceptively simple to install and use.

DESCRIPTION OF PREFERRED EMBODIMENT

Figure 1:
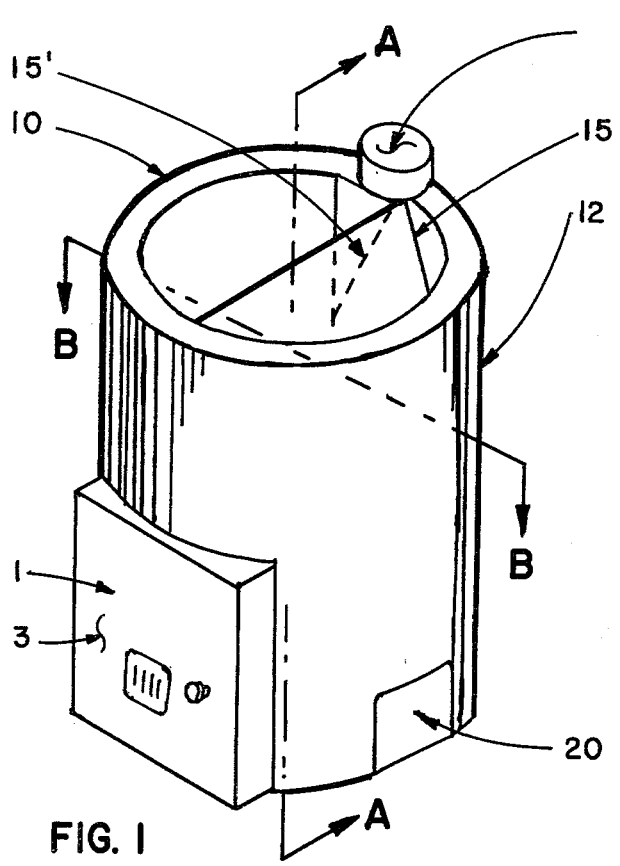
FIG. 1 is an angular perspective view of the device.
Figure 4:
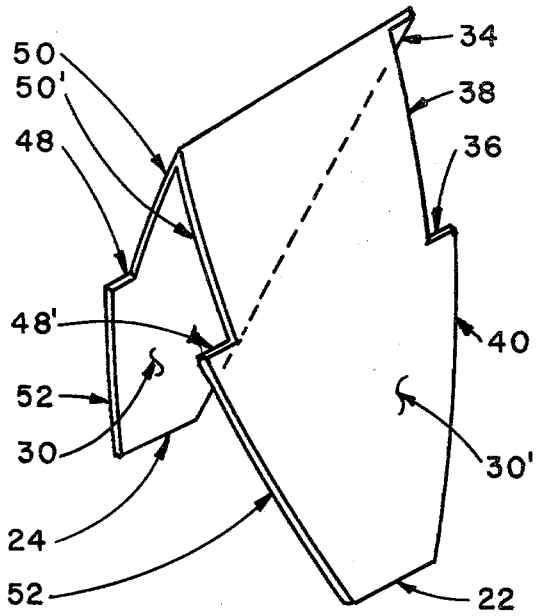
FIG. 4 is a view of the tent or A-shaped member which constitutes the fire box side walls.
Figure 2:
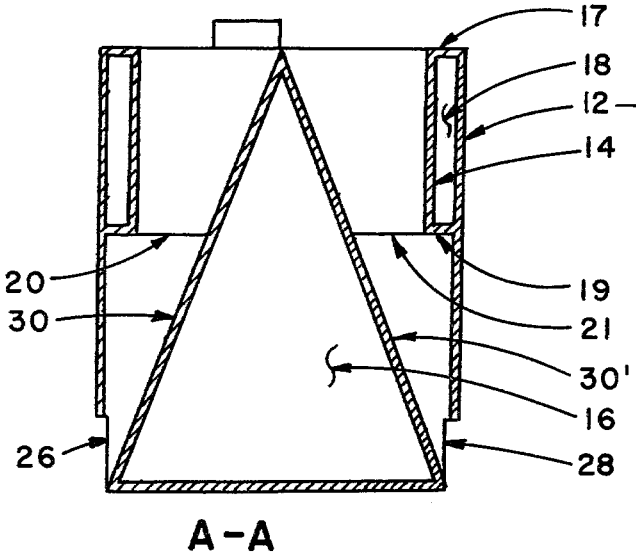
FIG. 2 is a vertical cross section on the line A—A of FIG. 1.

Referring more in detail to the drawings, the heating unit is designated by the numeral 10 and is comprised of three essential elements: an outer jacket 12, an inner jacket 14 and a tent or A-shaped fire box or combustion chamber 16.

The outer cylinder 12 defines the spacial limits of the heater except for an access door 13. The inner jacket 14 is an incomplete cylinder, having separated end edges 15 and 15' which are cut at an angle to the vertical to conform to the slanted walls of the fire box or combustion chamber 16 to which they are attached as will later be described.

In the preferred embodiment, the jackets 12 and 14 are described as cylindrical, and the fire box as A- or tent shaped. The invention is not limited to these specific configurations, but within the scope of the claims, may be of other designs suited to various places of installation. For example, the jackets 12 and 14 may be rectangular.

These three elements, the outer and inner jackets 12 and 14 and the tent or A-shaped fire box 16 are secured together to form an integral unit 10, movable and installable as a unit. Three separate interior areas or chambers are formed, a combustion chamber 16, a residual burning chamber 18 and a pair of clean air passageways 20 and 21. The upper and lower ends, 17 and 19 respectively, close the toroidal residual burning chamber 18.

The manner in which these elements are assembled and attached to each other is unique to the invention and an essential part of it. A heater is produced that is deceptively simple to install and operate, and yet produces heat with extremely high efficiency.

Because of the manner later described of attachment of the walls of the fire box to inner and outer jackets, the base edges 22 and 24 coincide with the openings 26 and 28, so that air entering these openings is immediately heated, and immediately convected upward.

All attachments to be described are attachments that afford air tight seals to insure complete separation of combustion gases and the medium being heated, which in this specific instance is air.

Figure 3:
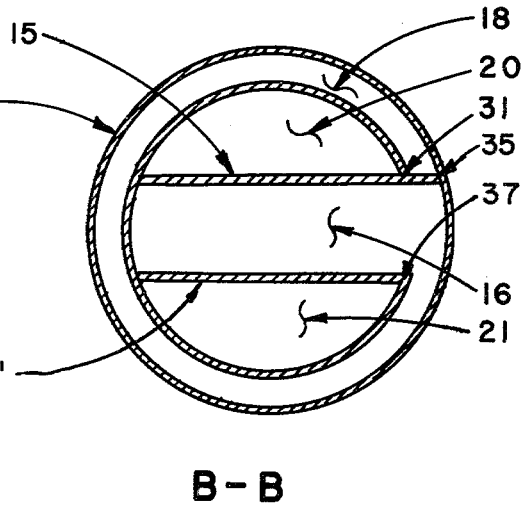
FIG. 3 is a cross sectional view of the device taken on the line B—B of FIG. 1.

For purposes of this description, the edges of the slanted walls 30 and 30' of the fire box will be designated first edge, second edge, third edge and fourth edge reading counter clockwise. The first edge 34 is integral throughout its length and is secured throughout its length to the interior surface of the outer jacket 12. See 35 in FIG. 3. The upper portion of the second edge is cut away to form a shoulder 36, an upper segment 38' and a lower segment 40. The upper segment 38 is secured to one of the separated edges of the inner jacket 14. See 37 in FIG. 3. The lower segment 40 is secured to the inner surface of the outer jacket 12. The second separated edge of the partial cylinder or inner jacket 14 is secured to an outer face of the fire box wall 30 as shown at 31 in FIG. 3. The angle to the vertical of each of the segments described is designed to meet and be secured to the walls of inner jacket 14, and outer jacket 12. The curve of the inner jacket may be modified so that the width of the upper end element is widened to accommodate a final vent 49.

The upper portions of the third and fourth edges have been cut away to form shoulders 48 and 48', upper segments 50 and 50' and lower segments 52 and 52'. The upper segments 50 and 50' are secured to the inner jacket 14. The last named lower segments 52 and 52' are secured to the inner surface of the outer jacket. The inner jacket 14 rests on and is supported by the shoulders 36, 48 and 48'. The manner of attachment of the separated ends of the inner jacket to, first the segment 38, and second to the outer surface of the fire box at 31, provides communication between fire box and residual burning chamber. At the same time complete sealing of the clean air passage from the burning materials is insured.

Materials used in manufacture may be cast iron, sheet steel or any other heat resistant material.

While the invention is shown and described in connection with one form for illustrative, rather than restrictive purposes, it is obvious that changes and modifications may be made by those skilled in the art without departing from the scope and spirit of the invention as defined in the accompanying claims:

I claim:

1. In a heater: a combustion chamber of tent-shaped configuration, a pair of joined and slanted walls on said combustion chamber, said combustion chamber extending the entire vertical height of heater, an outer jacket defining the outer configuration of said heater, the entire surface of each of said slanted walls presenting a medium of heat exchange throughout their entire exterior surfaces, cut away portions located in the base areas of said outer jacket to provide ingress for clean air at the base edge on each of said slanted walls, said base edges terminating at the lower limit of said outer jacket and adjacent to said openings, thereby presenting to the clean air entering immediate heating and immediate upward convection, additional heating surfaces for transmitting heat to the clean air, said means comprising an inner jacket located inside said outer jacket in the upper area of said heater and forming with said outer jacket a residual burning chamber, means for sealing the interior of said combustion chamber and the interior of said residual burning chamber from the clean air being heated, said last named means comprising: edges on said slanted walls, these edges being designated for convenience, a first edge, a second edge, and third and fourth edges, said first edge being an integral line throughout its length, and being secured throughout its length to the inner surface of said outer jacket and in sealed relationship therewith, said second edge having an upper segment cut away to form a shoulder and a lower segment, said lower segment being secured to the inner surface of said outer jacket and in sealed relationship therewith, each of said third and fourth edges having upper portions cut away, forming upper and lower segments, said last named upper segments being secured to said inner jacket and in sealed relationship therewith, said last named lower segments being secured to the inner surface of said outer jacket and in sealed relationship therewith.

2. A heater as claimed in claim 1 wherein said inner jacket is an incomplete enclosure, separated ends on said inner jacket, said separated ends designated for convenience, first separated end and second separated end respectively, means for providing communication between combustion chamber and residual burning chamber, said means comprising sealed attachment of the upper segment on said second edge to separated end one of said inner jacket, and sealed attachment of separated end two to the exterior surface of one of said slanted walls.

3. In a heater as claimed in claim 2, a final vent in the upper area of said residual burning chamber and so located that burning materials are conducted through said opening and are conducted throughout the extent of the residual burning chamber before reaching said final vent.

* * * * *